United States Patent [19]

Gunne et al.

[11] 4,243,150

[45] * Jan. 6, 1981

[54] BOTTLE SEAL

[75] Inventors: Ingemar Gunne, Sollentuna; Bertil Almgren, Vällingby, both of Sweden

[73] Assignee: Siemens Aktiengesellschaft, Berlin & Munich, Fed. Rep. of Germany

[ * ] Notice: The portion of the term of this patent subsequent to Aug. 7, 1996, has been disclaimed.

[21] Appl. No.: 871,535

[22] Filed: Jan. 23, 1978

[51] Int. Cl.[2] ..... B65D 47/36; B65D 49/00

[52] U.S. Cl. ..... 215/247

[58] Field of Search ..... 215/247, 260, 270, 307, 215/355

[56] References Cited

U.S. PATENT DOCUMENTS

| | | | |
|---|---|---|---|
| 2,231,418 | 2/1941 | Trotter | 215/247 |
| 2,608,972 | 9/1952 | Chrigstrom | 215/247 |
| 3,101,863 | 8/1963 | Jackson | 215/247 |
| 3,330,281 | 7/1967 | Visser | 215/247 |
| 3,653,528 | 4/1972 | Wimmer | 215/247 |
| 3,904,059 | 9/1975 | Bellamy | 215/247 |

FOREIGN PATENT DOCUMENTS

| | | | |
|---|---|---|---|
| 209183 | 7/1957 | Australia | 215/247 |
| 484928 | 9/1953 | Italy | 215/247 |
| 472091 | 9/1937 | United Kingdom | 215/247 |
| 766778 | 1/1957 | United Kingdom | 215/247 |

*Primary Examiner*—Herbert F. Ross

*Attorney, Agent, or Firm*—Hill, Van Santen, Steadman, Chiara & Simpson

[57] ABSTRACT

A bottle seal for ink bottles used in automatic ink dispensing systems. The seal includes a stopper insertable in the neck of the bottle terminating in a lip seal with a central slot for receipt of an ink withdrawal needle. A plastic or metal foil seal overlies the stopper sealing the slit area. A resilient disk overlies the foil and has a central slit area aligned with the stopper slit area. A rigid cap receives the stopper, foil and disk and attaches the same to the bottle neck, the cap having an opening aligned with the slit areas.

7 Claims, 2 Drawing Figures

BOTTLE SEAL

BACKGROUND OF THE INVENTION

1. Field of the Invention

This invention relates to bottle seals and more particularly to bottle seals for use in ink supply systems.

2. Prior Art

Bottle seals utilizing a stopper member constructed of a flexible or resilient material are well known including devices wherein the stopper includes an upper section dimensioned to sealingly contact the axial end wall of a bottle neck and a lower extension portion adapted to be received within the bottle neck. The lower section may seal against the inner diameter wall of the bottle neck. Such seals have heretofore been provided with centrally located slits for receipt of a liquid removal needle or pin. Additionally it has been known to supplement the elastic stopper with a rigid or semi-rigid cap member which clamps the stopper to the bottle, the cap member having a portion overlying the stopper and urging it axially against the bottle with an integral portion circumferentially surrounding a head end of the bottle and having a radially inturned end to underline a ledge at the bottom of the bottle head. It has further been known to provide a concentric opening in the cap member for receipt of the liquid removal needle.

A bottle seal of the above described type has been employed in sealing bottles containing recording fluid such as ink which are used in association with recording devices utlizing the ink. Such recording devices may, for example, be printing devices, stylus graphing devices and the like. In order to prevent undesired ink flow through the slit and concentric opening, it has been known to provide a sealing disk which is interposed between the cap member and a second cap member. In such double cap devices the exterior metal cap must first be torn away to allow removal of the sealing disk prior to insertion of the bottle into the liquid utilizing apparatus. Such apparatus generally includes a projecting hollow pin member or needle which projects through the slit area into the interior of the bottle.

While such double cap devices prevent leakage during transport and storage, they have numerous disadvantages. A first disadvantage is the fact that it is readily possible to cut oneself when tearing the outer cap off. A second disadvantage arises from the fact that recording fluid can leak out of the preslit stopper as the bottle is being turned over prior to the bottle's being fully seated on the liquid removal needle. Additionally, of course, because of the multi cap nature of the construction, manufacturing costs are relatively high.

It would therefore be an advance in the art to provide a bottle seal of the type having an elastic stopper with a preslitted area for receipt of a liquid withdrawal needle where the stopper is completely sealed by a means which does not require disassembly or removal of any sealed portions.

SUMMARY OF THE INVENTION

It is therefore an object of this invention to provide a bottle seal of the type described above which has relatively few individual parts, which eliminates the necessity of tearing off any of the parts and which prevents leakage of recording fluid from the bottle prior to fitting of the bottle onto a liquid removal needle.

According to this invention, the principal object is achieved through the use of a thin foil or plastic sheet which is positioned between the upper axial end of the stopper and the overlying seal cap. The foil is positioned such as to effect a seal with the foil covering the entire upper end of the stopper and therefore being capable of preventing leakage through the underlying slit area. The foil is maintained thin enough so as to be perforatable by the liquid removal needle. Since the foil is maintained in place until it is pierced by the needle, it prevents liquid leakage when the bottle is inverted for insertion into the liquid utilizing apparatus.

In a further development of the invention, a resilient disk is interposed between the foil and the enclosure cap. This resilient disk is provided with at least one slit aligned with the stopper slit. Thus the liquid removal needle will project through the disk slit. In this embodiment the foil will be mechanically protected by the disk and further, during insertion of the liquid removal needle, the needle will be guided by the disk slit so as to perforate the foil in the proper area aligned with the stopper slit.

It is therefore an object of this invention to provide an improved bottle stopper.

It is another, and more particular object of this invention to provide an improved bottle seal for use in connection with liquid dispensing bottles with the seal adapted to be pierced by a liquid withdrawal needle, the seal including a stopper receivable in the neck of the bottle with a slit opening therethrough, a foil or plastic sheet overlying the top of the stopper sealing the slit area, and an enclosure cap maintaining the foil in place on the stopper and the stopper in place on the bottle, the foil being piercable by the liquid withdrawal needle.

It is yet another, and particular, object of this invention to provide an improved bottle seal of the type used in connection with liquid bottles wherein the liquid contents are to be withdrawn from the bottle through a liquid withdrawal needle or member which is pressed through the seal, the seal including a stopper having a portion insertable into the neck of the bottle and a portion overlying the head end of the bottle neck in sealing engagement therewith, the stopper equipped with a central slot for receipt of the liquid withdrawal needle, the slot area sealed by a foil or plastic sheet overlying the stopper exterior of the bottle, a resilient disk member overlying the foil or plastic sheet having a central slit area aligned with the stopper slit area, and a cap member engaging the disk and urging it towards the bottle, the cap member effective to maintain the seal on the bottle with the cap member having an aperture therethrough aligned with the disk slit and the stopper slit, the foil being pierceable by a liquid withdrawal device.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENT

Figure 1:
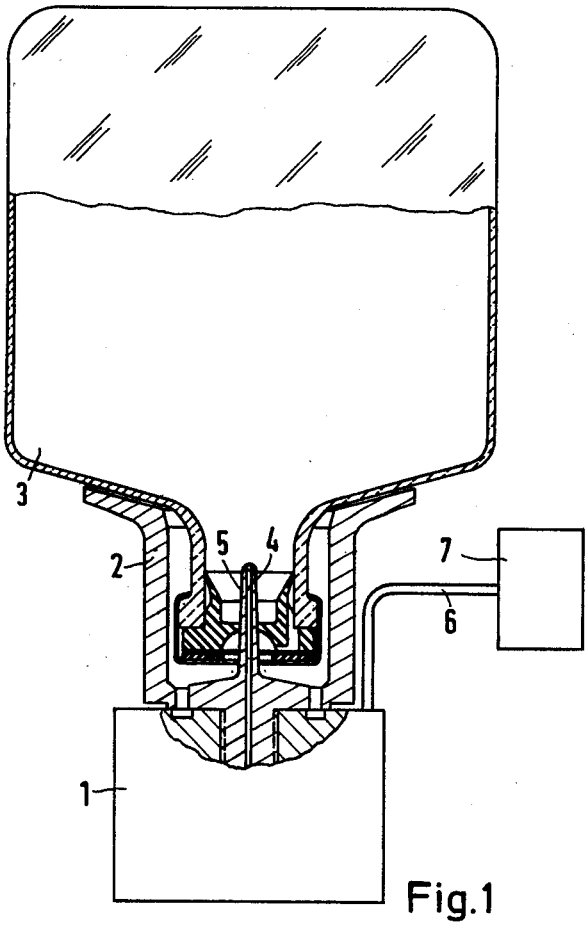
FIG. 1 is an elevational view partially in section of a bottle equipped with a stopper according to this invention in position in a liquid withdrawal device.

FIG. 1 illustrates a pump device 1 which includes a support mount 2 for receipt of a bottle 3 containing a liquid to be fed to the pump 1. The pump is not specifically illustrated as it forms no specific part of this invention. However, the support 2 is of that type which receives the bottle with the neck of the bottle interior of the support with the bottle inverted so as to be able to supply liquid to the pump. Thus, disposed within the support 2 is a liquid removal needle or pin 5 which has a liquid withdrawal channel 4 therethrough. The bottle 3 is pushed into the support 2 and onto the needle 5 until the needle pierces through the bottle seal opening the channel 4 interior to the liquid of the bottle. Thus the channel 4 communicates the liquid to the pump 1. Upon actuation of the pump 1, the fluid within the bottle will be withdrawn through the channel 4 and into the pump. The pump is in communication via a conduit 6 with a liquid utilizing the device 7 such as the recording portion of a recording machine. In such an instance the liquid will be an ink utilized by the recorder.

Figure 2:
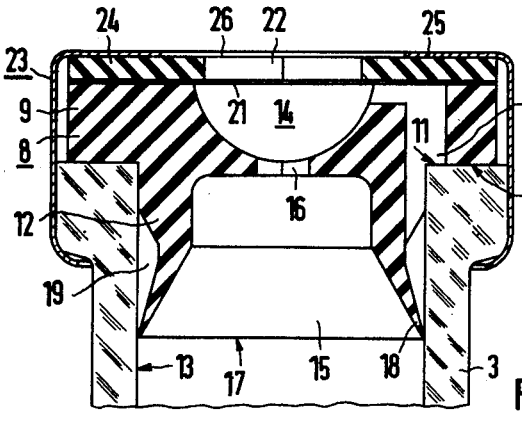
FIG. 2 is an enlarged fragmentary cross section of the neck of a bottle equipped with a seal according to this invention.

The seal of the bottle 3 is best illustrated in FIG. 2 which shows the seal prior to fitting of the bottle into the support 2 and piercing of the seal by the needle 5. The bottle seal includes a stopper 8 which is preferably formed of a resilient or flexible material such as rubber. The stopper has an upper section 9 having a radially outwardly extending ledge which provides a seal surface 10 for engagement with the axial end face 11 of the bottle neck. Further the stopper has a central axial extension 12 projecting from the upper portion and dimensioned to be received interiorly of the bottle neck. The extension 12 is dimensioned such as to provide a seal with the inner diameter wall of the bottle neck.

Further the stopper 8 has aligned upper and lower recesses 14 and 15 divided from one another by a wall portion having a cross shaped slit 16 therethrough for communication of the recesses. Additionally the extension 12 terminates interior of the bottle in a lip seal 18 constructed at the free end 17 of the extension. A ring shaped groove 19 extends into the extension adjacent the lip seal 18 helping to define the lip seal while at the same time providing a space between the bottom of the groove and the wall of the bottle neck. An air channel 20 extends from the groove 19 to the upper recess 14 and functions to provide aeration of the bottle as further explained hereafter.

A thin foil or plastic sheet 21 is positioned over the entire upper side of the stopper 8 in such a manner as to provide a stopper seal. Thus the foil 21 closes the recess 14. A resilient disk member 24 overlies the foil maintaining it in place on the stopper. The disk member has a central portion provided with a cross shaped slit 22 which is aligned with the recess 14 and, preferably is concentric with the slit 16. Finally, a metal cap 23 is provided to clamp or squeeze the stopper 8, foil 21 and disk 24 against the neck of the bottle 3. The cap 23 has a concentric opening 26 in its axial end face 25 which is aligned with, and preferably concentric with the slit portions 22 and 16.

When the bottle 3 is to be pressed onto the liquid removal needle 5, the cap opening 26 is first aligned with the end of the needle. Then by application of an axial pressure on the bottle, the needle will first penetrate the slit 22, and be guided thereby thence the foil 21 and thence the slit 16 into the interior of the bottle neck. Slit 16 is dimensioned with respect to the needle such that after receipt of the needle through the slit 16, the periphery of the slit will seal against the periphery of the needle. Slit 22, on the other hand, is preferably sufficiently larger than the needle so as to allow air passage through the slit around the periphery of the needle to the interior of the recess 14. In this manner as the bottle 3 is emptied of its contents by the pump 1, pressure reduction between the interior of the bottle and the exterior thereof will cause an air flow through the slit 22 to the recess 14 and thence through channel 20 to the groove 19. When the pressure differential is great enough, the resilient force of the lip seal 18 will be overcome allowing air to stream or bubble past the lip seal to the interior of the bottle thereby resulting in aeration of the bottle. Air flow will continue into the interior of the bottle 3 until a pressure compensation has been established at which time the lip 18 will return to its initial sealed engagement with the wall of the bottle neck preventing further air leakage through the channel 20.

It can therefore be seen from the above that this invention provides a novel bottle seal of the type adapted to be pierced by a liquid withdrawal needle, particularly for use in connection with ink supply devices. The seal comprises a resilient stopper having a portion sealingly engagingly an axial end of the bottle and an extension portion received in the bottle neck terminating in a lip seal in engagement with the bottle neck inner diameter wall. The stopper has aligned inner and outer recesses divided by a wall having a slit therethrough for communication of the recesses. The outer recess is closed by a piercable foil overlying the stopper. In one embodiment the foil is overlied by a compressible disk having a central slit therethrough aligned with the stopper slit. A metal closure cap affixes the seal to the bottle and has a portion overlying the disc urging the disk against the foil, the foil against the stopper and the stopper against the axial end of the bottle neck. In another embodiment the disk is not Although the teachings of our invention have herein been discussed with reference to specific theories and embodiments, it is to be understood that these are by way of illustration only and that others may wish to utilize our invention in different designs or applications.

We claim as our invention:

1. In a bottle seal including a resilient material stopper having a first axial end section adapted to overlie an axial end of a bottle neck and having a radially extending surface for sealingly engaging the axial end of the bottle neck, the stopper having an axial extension for projecting into the bottle neck and sealingly engaging the inner diameter of the bottle neck, with a slit through the stopper for receipt of a liquid withdrawal needle, and a metal cap overlying the stopper and adapted to attach the stopper to the bottle neck, the metal cap having an opening through an end face thereof aligned with the slit, the improvement of a thin foil member interposed between an axial end of the stopper exterior of the bottle and the metal cap, the foil underlying the opening in the metal cap and overlying the slit, the foil sealing the stopper, and the foil being piercable by a liquid withdrawal needle, a resilient disk is interposed between the metal cap and the foil, the resilient disk having a central slit therethrough, the slit aligned with the opening in the metal cap and with the slit in the stopper, the stopper has an axial extension receivable interior of the neck of the bottle, the axial extension terminating interior of the neck of the bottle in a lip seal engageable with an inner diameter wall of the bottle neck, the extension having an annular groove therearound for defining an air spaced between the extension and the inner diameter wall of the neck of the bottle adjacent the lip seal, an air channel communicating the groove to the exterior of the stopper interior of the foil.

2. A bottle seal according to claim 1 wherein the stopper has an axial extension receivable interior of the neck of the bottle, the axial extension terminating exterior of the neck of the bottle in a lip seal engageable with an inner diameter wall of the bottle neck, the extension having an annular groove therearound for defining an air space between the extension and the inner diameter wall of the neck of the bottle adjacent the lip seal, an air channel communicating the groove to the exterior of the stopper interior of the foil.

3. A bottle seal according to claim 1 wherein the stopper has a central axially extending recess in its upper section open to a top of the stopper, the recess open to a bottom face of the stopper through the stopper slit, the recess having a dimension greater than the diameter of the liquid withdrawal needle and the air channel open to the recess.

4. A bottle seal according to claim 4 wherein the stopper has a central axially extending recess in its upper section open to a top of the stopper, the recess open to a bottom face of the stopper through the stopper slit, the recess having a dimension greater than the diameter of the liquid withdrawal needle and the air channel open to the recess.

5. A bottle seal according to claim 3 wherein a resilient disk is interposed between the metal cap and the foil, the resilient disk having a central slit therethrough, the slit aligned with the opening in the metal cap and with the slit in the stopper, the disk slit being larger than the stopper slit and the stopper slit dimensioned to seal a liquid withdrawal needle received therein.

6. A bottle seal according to claim 4 wherein a resilient disk is interposed between the metal cap and the foil, the resilient disk having a central slit therethrough, the slit aligned with the opening in the metal cap and with the slit in the stopper, the disk slit being larger than the stopper slit and the stopper slit dimensioned to seal a liquid withdrawal needle received therein.

7. A bottle seal comprising a resilient stopper having an upper section adapted to overlie the end of a neck of a bottle and having a radial wall portion for engagement with an axial end of a bottle neck, an axial projection section for receipt interior of the bottle neck having an outer diameter dimensioned to engage an inner diameter wall of the bottle neck in sealing engagement therewith, the extension terminating in a lip seal, the stopper having aligned inner and outer recesses communicating to one another through a slit area in a wall portion dividing the recesses, the slit area dimensioned to sealingly engage a liquid withdrawal needle thrust therethrough, a pierceable foil sheet overlying the stopper closing the outer recess and sealingly engaging an exterior end of the stopper, a metal cap member having an end portion overlying the end of the stopper and peripheral portions adapted to engage the bottle neck to maintain the stopper on the bottle neck, the cap having an end portion central opening therethrough aligned with the stopper slit area, the foil underlying the cap opening, a resilient disk is interposed between the end portion of the cap and the foil, the disk having a central slot therethrough aligned with the recesses and the stopper slot, the cap end portion overlying the disk, the cap opening aligned with the disk slot, the disk slot and the upper recess have a dimension greater than the diameter of a liquid withdrawal needle to be inserted into the bottle through the seal whereby air can flow past the needle through the disk slot to the upper recess, an air channel extends from the upper recess to an annular groove in the outer diameter of the extension adjacent the lip seal.

* * * * *